US009159477B2

(12) United States Patent
Fu et al.

(10) Patent No.: US 9,159,477 B2
(45) Date of Patent: Oct. 13, 2015

(54) LAMINATED CHIP COMPOSITE RESISTOR COMBINING THERMISTOR AND VARISTOR AND PREPARATION METHOD THEREOF

(71) Applicant: Huazhong University of Science and Technology, Wuhan (CN)

(72) Inventors: Qiuyun Fu, Wuhan (CN); Dongxiang Zhou, Wuhan (CN); Yunxiang Hu, Wuhan (CN); Zhiping Zheng, Wuhan (CN); Wei Luo, Wuhan (CN); Tao Chen, Wuhan (CN)

(73) Assignee: HUAZHONG UNIVERSITY OF SCIENCE AND TECHNOLOGY, Wuhan (CN)

( * ) Notice: Subject to any disclaimer, the term of this patent is extended or adjusted under 35 U.S.C. 154(b) by 0 days.

(21) Appl. No.: 14/320,323

(22) Filed: Jun. 30, 2014

(65) Prior Publication Data

US 2015/0145639 A1 May 28, 2015

(30) Foreign Application Priority Data

Nov. 23, 2013 (CN) ..... 2013 1 0601977

(51) Int. Cl.

| | |
|---|---|
| ***H01C 7/10*** | (2006.01) |
| ***H01C 17/00*** | (2006.01) |
| ***H01C 13/02*** | (2006.01) |
| ***H01C 7/00*** | (2006.01) |

(52) U.S. Cl.

CPC ..... *H01C 17/006* (2013.01); *H01C 7/008* (2013.01); *H01C 7/10* (2013.01); *H01C 13/02* (2013.01)

(58) Field of Classification Search

CPC .... H01C 7/112; H01C 17/0652; H01C 7/005; H01C 7/18; H01C 13/02; H01C 17/006; H01C 17/281; H01C 17/30; H01C 7/008; H01C 7/10

USPC ..... 338/22 R, 20, 13; 29/602.1, 612

See application file for complete search history.

(56) References Cited

U.S. PATENT DOCUMENTS

| | | | | |
|---|---|---|---|---|
| 4,981,633 | A * | 1/1991 | Alles et al. | 264/616 |
| 5,313,184 | A * | 5/1994 | Greuter et al. | 338/21 |
| 5,379,022 | A * | 1/1995 | Bacon et al. | 338/20 |
| 6,157,290 | A * | 12/2000 | Glatz-Reichenbach et al. | 338/22 R |
| 6,535,105 | B2 * | 3/2003 | Heistand et al. | 338/226 |
| 7,015,787 | B2 * | 3/2006 | Nakamura | 338/20 |
| 7,084,732 | B2 * | 8/2006 | Krumphals | 338/22 R |
| 7,660,096 | B2 * | 2/2010 | Golubovic et al. | 361/124 |
| 8,009,012 | B2 * | 8/2011 | Kajino et al. | 338/309 |
| 2007/0063330 | A1 * | 3/2007 | Park et al. | 257/686 |
| 2009/0108984 | A1 * | 4/2009 | Choi et al. | 338/22 R |

* cited by examiner

*Primary Examiner* — Kyung Lee

(74) *Attorney, Agent, or Firm* — Davis Wright Tremaine LLP

(57) ABSTRACT

Provided are a laminated chip composite resistor combining a thermistor and a varistor, and a preparation method thereof. The composite resistor comprises a varistor part, a transition layer part and a thermistor part overlapped sequentially, wherein the varistor part is formed by alternately laminating a ceramic layer of a varistor, a first electrode layer, another ceramic layer of a varistor and a second electrode layer; the thermistor part is formed by alternately laminating a ceramic layer of a thermistor, a third electrode layer, another ceramic layer of a thermistor and a fourth electrode layer; and the transition layer part is located between the thermistor part and the varistor part. Co-firing is employed and the base metal Ni is the main material of inner electrodes, which can reduce costs, simplify the preparation process, and improve the reliability.

10 Claims, 2 Drawing Sheets

LAMINATED CHIP COMPOSITE RESISTOR COMBINING THERMISTOR AND VARISTOR AND PREPARATION METHOD THEREOF

CROSS-REFERENCE TO RELATED APPLICATIONS

The present application is a U.S. non-provisional application which claims priority to Chinese Application No. 201310601977.4, filed on Nov. 23, 2013, which is herein incorporated by reference in its entirety.

FIELD OF THE INVENTION

The present invention relates to preparation of ceramic electronic components, and more particularly to a laminated chip composite resistor combining a thermistor and a varistor and a preparation method thereof.

BACKGROUND OF THE INVENTION

Electronic appliances are developing rapidly toward miniaturization, low-cost and high-density integration, which leads to lamination and multi-function of sensitive semiconductor ceramic components. 3D integration is the best solution to achieve multi-function and multi-device integration of a passive electronic component in which an inner metal electrode and a ceramic material should be co-fired. The inner metal electrode material tends to be oxidized at high temperature, so that the co-firing process is required to be carried out in a reducing or an inert atmosphere. However, electrical properties of most of the semiconductor ceramics sintered in the above atmosphere tend to be deteriorated or even lost, so that a re-oxidation treatment should be imposed on the co-firing body in air or oxygen at a temperature lower than the sintering temperature to obtain excellent electrical properties, which is known as a method of reduction and re-oxidation. By the above method, a chip component can use base metal for an inner electrode and an effective way is provided for lamination, multi-function and low-cost of ceramic components.

Barium titanate based positive temperature coefficient (PTC) thermistor ceramics and zinc oxide based varistor ceramics are not only two of the most typical sensitive ceramic materials that combine semiconduction of grains with anomalous effects of grain boundaries, but also two of the most widely used semiconductor ceramic materials. Barium titanate-based PTC thermistor ceramics have a significant thermal switching characteristic which can be used as an overload protection device to realize automatic protection and automatic restoration when an abnormal overheating or an abnormal overcurrent occurs. And ZnO-based varistors have an excellent non-linear voltage characteristic, which can provide overvoltage protection for IC devices and electronic circuits so as to prevent damages caused by electrostatic discharge, surges and other impacts by transient currents (such as lightning strikes, etc.). It can be inferred that ZnO varistors and $BaTiO_3$ PTC thermistors are two types of complementary components for circuit protection, and it has a broad application prospect by preparing a composite component combining a thermistor and a varistor taking the advantage of the above two resistors to achieve comprehensive protection of over-voltage and over-current simultaneously. Furthermore, the PTC thermistor can protect the varistor from failure or even a disaster caused by overload (for example, large fluctuation of the voltage, imposing excessive energy on the component, performance deterioration, etc.), which plays an important role in improving reliability and security of electronic devices.

The research of a multi-functional composite chip component combining a thermistor and a varistor can be traced back to 1989. However, there is no breakthrough in the past 20 years. So far, there are only 7 patents about lamination in a total of 95 patents about a composite ceramic component combining a thermistor and a varistor. Each of the patent JP1152704 of Japan Murata in 1989, the Patent KR20060093628 of Korea in 2005, and the patent CN102047353 applied by Germany-based Dehn and Thorne in China in 2005 prepares a composite component combining a thermistor and a varistor by mechanical mounting, which are complexity, high-cost and low reliability.

SUMMARY OF THE INVENTION

It is an objective of the invention to provide a laminated chip composite resistor combining a thermistor and a varistor and a preparation method thereof. Co-firing is employed and a base metal Ni is used for inner electrodes to prepare a composite resistor combining a thermistor and a varistor, which can reduce costs, simplify the preparation process, achieve effective composition of a thermistor and a varistor, improve the reliability, reduce the path of heat conduction, strengthen the protection of a varistor by a thermistor, and realize comprehensive protection from over-heat, over-current and over-voltage.

To achieve the above objective, in accordance with one embodiment of the invention, there is provided a method for preparing a laminated chip composite resistor combining a thermistor and a varistor, comprising steps of:

(1) generating green sheets of a thermistor and green sheets of a varistor using formulation powders of a thermistor and a varistor respectively via a tape casting method, in which the formulation powder of a varistor is obtained by: adding an oxide of manganese (Mn) and an oxide of cobalt (Co) into a mixture of zinc oxide (ZnO) and bismuth oxide ($Bi_2O_3$), adding deionized water thereto for ball-mill mixing, drying and sieving generated slurry whereby obtaining powders, where a molar fraction of ZnO is 93% to 98.7%, a molar fraction of $Bi_2O_3$ is 0.2% to 5%, molar fractions of the Mn oxide and the Co oxide are both 0.01% to 5%;

the formulation powder of a thermistor is obtained by mixing nano or sub-micron barium titanate ($BaTiO_3$) thermal sensitive ceramic powder containing trivalent rare earth elements or pentavalent metal elements, in which an atomic ratio of the mixed trivalent rare earth elements to the barium (Ba) element is no greater than 1%, an atomic ratio of the pentavalent metal elements to the Titanium (Ti) element is no greater than 1%, and an atomic ratio of the Ba element and the trivalent rare earth elements to the Ti element and the pentavalent metal elements is within a range between 0.99 and 1.01;

(2) mixing the formulation powder of the thermistor with that of the varistor according to a mass ratio of 1:2 to 2:1, ball-milling the mixture so that it is uniformly mixed, performing tape casting on the mixed powder whereby obtaining a green sheet with a thickness of 20 μm to 60 μm which operates as a green sheet of a transition layer;

(3) alternately laminating the green sheets of the varistor and nickel (Ni) electrodes, overlying the green sheet of the transition layer thereon, alternately laminating the green sheets of the thermistor and nickel (Ni) electrodes on the green sheet of the transition layer, performing hot isostatic pressing thereon, and cutting an obtained green sheet to a desired size according to electrode patterns thereof;

(4) processing the resistor in air at temperature below 500° C. after cutting;

(5) sintering the processed resistor in a protective atmosphere at temperature of 850° C. to 1150° C., performing heat treatment thereon in oxygen or air at temperature of 500° C. to 800° C., coating Ag electrode thereon, and burning the Ag electrode.

In a class of this embodiment, the thermal sensitive ceramic powder in the step (2) is obtained by a method for preparing nano powder.

In a class of this embodiment, the method for preparing nano powder specifically refers to a hydrothermal method or a sol-gel method.

In a class of this embodiment, in the step (1), an oxide of aluminum (Al) and/or an oxide of niobium (Nb) is/are added into the mixture of ZnO and $Bi_2O_3$, and the total amount thereof being added is no greater than 4 mol %.

In a class of this embodiment, in the step (1), any one or more of an oxide of chromium (Cr), an oxide of antimony (Sb), an oxide of silicon (Si) and an oxide of vanadium (V) is/are added into said mixture of ZnO and $Bi_2O_3$, and the total amount thereof being added is no greater than 8 mol %.

In a class of this embodiment, the duration of ball-mill mixing in the step (1) is 3 to 5 hours.

In a class of this embodiment, an average particle size of the thermal sensitive ceramic powder in the step (1) is no greater than 200 nm.

To achieve the above objective, in accordance with another embodiment of the invention, there is provided a laminated chip composite resistor combining a thermistor and a varistor prepared by the above method.

To achieve the above objective, in accordance with another embodiment of the invention, there is provided a laminated chip composite resistor combining a thermistor and a varistor, comprising a varistor part, a transition layer part and a thermistor part overlapped sequentially, wherein the varistor part is formed by alternately laminating a ceramic layer of a varistor, a first electrode layer, another ceramic layer of a varistor and a second electrode layer, wherein the first electrode layer and the second electrode layer are staggered, an end of the first electrode layer is operated as a common end of inner electrodes of the composite resistor combining a thermistor and a varistor, and an end of the second electrode layer is operated as a common end of inner electrodes of the varistor;

the thermistor part is formed by alternately laminating a ceramic layer of a thermistor, a third electrode layer, another ceramic layer of a thermistor and a fourth electrode layer, wherein the third electrode layer and the fourth electrode layer are staggered, an end of the third electrode layer is operated as a common end of inner electrodes of the composite resistor combining a thermistor and a varistor, and an end of the fourth electrode layer is operated as a common end of inner electrodes of the thermistor; and the transition layer part is located between the thermistor part and the varistor part.

In a class of this embodiment, an electrode material of the first electrode layer, the second electrode layer, the third electrode layer and the fourth electrode layer is nickel (Ni).

Advantages of the invention over the prior art comprise:

(1) The composite component is prepared by co-firing a varistor part and a thermistor part so that the process is simplified and the cost is reduced.

(2) The thermistor part and the varistor part are formed in one chip, which can reduce the path and duration of heat transfer from the heated varistor to the thermistor, so that the varistor can be protected in time.

(3) A transition layer is introduced between the thermistor part and the varistor part so as to realize effective match of the thermistor and the varistor during co-firing.

(4) The base metal Ni is used for inner electrodes so as to significantly reduce the material costs of the laminated chip composite resistor.

(5) The sintering temperature and the densification rate of the thermistor material and the varistor material are consistent by using Nano-powder as the thermistor material and adding sintering aids, and by controlling the density so as to realize co-firing.

DESCRIPTION OF THE ACCOMPANYING DRAWINGS

DETAILED DESCRIPTION OF THE INVENTION

For clear understanding of the objectives, features and advantages of the invention, detailed description of the invention will be given below in conjunction with accompanying drawings and specific embodiments. It should be noted that the embodiments are only meant to explain the invention, and not to limit the scope of the invention.

In the present invention, co-firing is employed and a base metal Ni is used for inner electrodes to prepare a composite resistor combining a thermistor and a varistor, which can reduce costs, simplify the preparation process, achieve effective composition of a thermistor and a varistor, improve the reliability, reduce the path of heat conduction, and strengthen the protection of a varistor by a thermistor.

Figure 1:
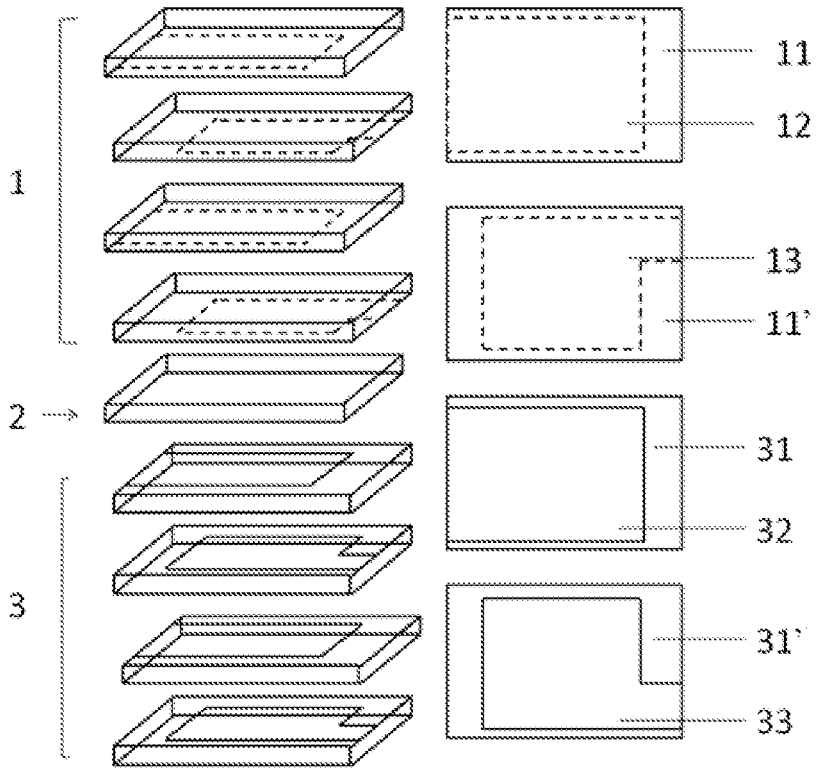
FIG. 1 is a resolved schematic diagram of a laminated chip composite resistor combining a thermistor and a varistor according to the present invention.

To achieve the above objectives, a tape casting process is employed to prepare green sheets of a thermistor and green sheets of a varistor respectively, the base metal Ni is used for preparing inner electrode slurry, and a green body of a composite resistor shown in FIG. 1 is formed by lamination and printing, which is sintered in a protective atmosphere to a ceramic body and then is oxidized in air or oxygen.

The varistor material of the present invention mainly comprises ZnO. Besides, oxides of Bi, Mn and Co are required ingredients. An oxide of Al and/or an oxide of Nb may be added, or one or more of oxides of Cr, Sb, Si and V may be added.

The thermistor material of the present invention is nano-powder mainly comprising $BaTiO_3$. Besides, one of yttrium (Y) element, trivalent rare earth elements and pentavalent metal elements is required to be added. One or more of oxides of Ca, Sr, Pb, Ti, Mn, Si and B may be added.

A green sheet of a transition layer of the present invention is prepared by mixing the varistor material and the thermistor material.

The sintering temperature in a protective atmosphere is between 850° C. and 1150° C., and the optimum sintering temperature is related to the ingredients and the proportions thereof. A ceramic body can't be formed completely if the temperature is too low, and electrical properties of the device deteriorate if the temperature is too high. Then, a laminated chip composite resistor combining a thermistor and a varistor is prepared by performing heat treatment in oxygen or air at temperature of 500° C. to 800° C.

FIG. 1 is a resolved schematic diagram of a laminated chip composite resistor combining a thermistor and a varistor according to the present invention. As in FIG. 1, the laminated chip composite resistor combining a thermistor and a varistor of the present invention comprises a varistor part 1, a transition layer part 2 and a thermistor part 3 overlapped sequentially, wherein varistor part 1 is formed by alternately laminating a ceramic layer of a varistor 11, a first electrode layer 12, another ceramic layer of a varistor 11' and a second electrode layer 13, wherein first electrode layer 12 and second electrode layer 13 are staggered, an end of first electrode layer 12 is operated as a common end of inner electrodes of the composite resistor combining a thermistor and a varistor, and an end of second electrode layer 13 is operated as a common end of inner electrodes of the varistor; thermistor part 3 is formed by alternately laminating a ceramic layer of a thermistor 31, a third electrode layer 32, another ceramic layer of a thermistor 31' and a fourth electrode layer 33, wherein third electrode layer 32 and fourth electrode layer 33 are staggered, an end of third electrode layer 32 is operated as a common end of inner electrodes of the composite resistor combining a thermistor and a varistor, and an end of fourth electrode layer 33 is operated as a common end of inner electrodes of the thermistor; and transition layer part 2 is located between thermistor part 3 and varistor part 1. Advantageously, an electrode material of first electrode layer 12, second electrode layer 13, third electrode layer 32 and fourth electrode layer 33 is nickel (Ni).

Figure 2:
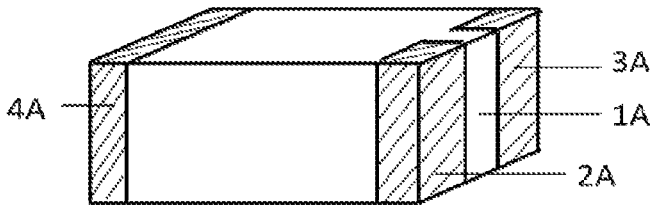
FIG. 2 is a perspective view of a laminated chip composite resistor combining a thermistor and a varistor according to the present invention.

A stereo structure of a laminated chip composite resistor combining a thermistor and a varistor in FIG. 2 is formed by laminating the three parts in FIG. 1 and coating Ag electrode at ends 2A, 3A and 4A. The stereo structure can be divided in to four regions according to electrodes, namely, a ceramic body 1A of the composite resistor combining a thermistor and a varistor, an outer electrode 2A of the varistor, an outer electrode 3A of the thermistor, and an outer electrode 4A of a common end.

Figure 3:
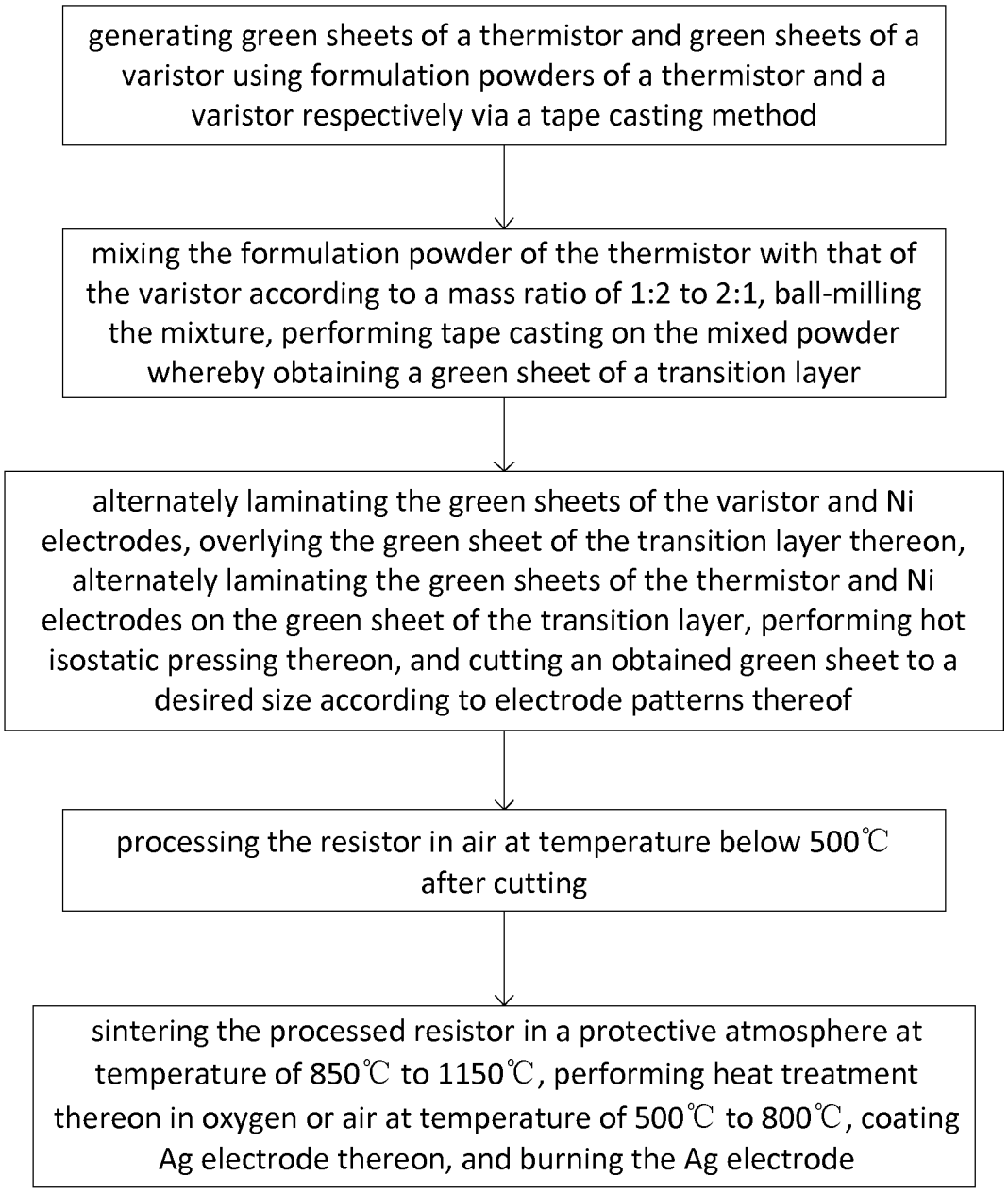
FIG. 3 is a flowchart of a method for preparing a laminated chip composite resistor combining a thermistor and a varistor provided by the present invention.

In order to prepare the above laminated chip composite resistor combining a thermistor and a varistor, a preferred method for preparing the above laminated chip composite resistor combining a thermistor and a varistor is illustrated as follows. As in FIG. 3, the method comprises the following steps of:

(1) generating green sheets of a thermistor and green sheets of a varistor using formulation powders of a thermistor and a varistor respectively via a tape casting method, in which the thickness of each of the green sheets is between 20 μm and 60 μm; the formulation powder of a varistor is obtained by: adding an oxide of manganese (Mn) and an oxide of cobalt (Co) into a mixture of zinc oxide (ZnO) and bismuth oxide ($Bi_2O_3$), adding deionized water thereto for ball-mill mixing for 3 to 5 hours advantageously, drying and sieving generated slurry whereby obtaining powders, where a molar fraction of ZnO is 93% to 98.7%, a molar fraction of $Bi_2O_3$ is 0.2% to 5%, molar fractions of the Mn oxide and the Co oxide are both 0.01% to 5%; the formulation powder of a thermistor is obtained by: mixing nano or sub-micron barium titanate ($BaTiO_3$) thermal sensitive ceramic powder containing trivalent rare earth elements or pentavalent metal elements, in which an atomic ratio of the mixed trivalent rare earth elements to the barium (Ba) element is no greater than 1%, an atomic ratio of the pentavalent metal elements to the Titanium (Ti) element is no greater than 1%, and an atomic ratio of the Ba element and the trivalent rare earth elements to the Ti element and the pentavalent metal elements is within a range between 0.99 and 1.01; an average particle size of the thermal sensitive ceramic powder is no greater than 200 nm;

(2) mixing the formulation powder of the thermistor with that of the varistor according to a mass ratio of 1:2 to 2:1, ball-milling the mixture so that it is uniformly mixed, performing tape casting on the mixed powder whereby obtaining a green sheet with a thickness of 20 μm to 60 μm which operates as a green sheet of a transition layer;

(3) alternately laminating the green sheets of the varistor and nickel (Ni) electrodes, overlying the green sheet of the transition layer thereon, alternately laminating the green sheets of the thermistor and nickel (Ni) electrodes on the green sheet of the transition layer, performing hot isostatic pressing thereon, and cutting an obtained green sheet to a desired size according to electrode patterns thereof;

(4) processing the resistor in air at temperature below 500° C. after cutting;

(5) sintering the processed resistor in a protective atmosphere at temperature of 850° C. to 1150° C., performing heat treatment thereon in oxygen or air at temperature of 500° C. to 800° C., coating Ag electrode thereon, and burning the Ag electrode.

Advantageously, the thermal sensitive ceramic powder in step (2) is obtained by a method for preparing nano powder.

Advantageously, the method for preparing nano powder specifically refers to a hydrothermal method or a sol-gel method.

Advantageously, in step (1), an oxide of aluminum (Al) and/or an oxide of niobium (Nb) is/are added into said mixture of ZnO and $Bi_2O_3$, and the total amount thereof being added is no greater than 4 mol %.

Advantageously, in step (1), any one or more of an oxide of chromium (Cr), an oxide of antimony (Sb), an oxide of silicon (Si) and an oxide of vanadium (V) is/are added into said mixture of ZnO and $Bi_2O_3$, and the total amount thereof being added is no greater than 8 mol %.

Advantages of the invention over the prior art comprise:

(1) The composite component is prepared by co-firing varistor part and thermistor part so that the process is simplified and the cost is reduced.

(2) The thermistor part and the varistor part are sintered to one chip, which can reduce the path and duration of heat transfer from the heated varistor to the thermistor, so that the varistor can be protected in time.

(3) A transition layer is introduced between the thermistor part and the varistor part so as to realize effective match of the thermistor and the varistor during co-firing.

(4) The base metal Ni is used for inner electrodes so as to significantly reduce the material costs of the laminated chip composite resistor.

(5) The sintering temperature and the densification rate of the thermistor material and the varistor material are consistent by using Nano-powder as the thermistor material and adding sintering aids, and by controlling the density so as to realize co-firing.

The nonlinear coefficient of the varistor of the composite resistor of the present invention is above 30, the breakdown voltage is below 20V, the log Rmax/R25 of the thermistor exceeds 3, and the resistance of the thermistor at room temperature is below 0.2Ω.

The ratio of a formulation powder to an organic solvent in the present invention is a typical ratio for organic tape casting and can be adjusted according to the quality of the film.

While preferred embodiments of the invention have been described above, the invention is not limited to disclosure in the embodiments and the accompanying drawings. Any changes or modifications without departing from the spirit of the invention fall within the scope of the invention.

What is claimed is:

1. A method for preparing a laminated chip composite resistor combining a thermistor and a varistor, comprising the steps of:

(1) generating green sheets of a thermistor and green sheets of a varistor using formulation powders of a thermistor and a varistor respectively via a tape casting method, in which said formulation powder of a varistor is obtained by: adding an oxide of manganese (Mn) and an oxide of cobalt (Co) into a mixture of zinc oxide (ZnO) and bismuth oxide ($Bi_2O_3$), adding deionized water thereto for ball-mill mixing, drying and sieving to generate a slurry, thereby obtaining powders with a molar fraction of ZnO of 93% to 98.7%, a molar fraction of $Bi_2O_3$ of 0.2% to 5%, and molar fractions of the Mn oxide and the Co oxide of 0.01% to 5% each;

said formulation powder of a thermistor is obtained by: mixing nano or sub-micron barium titanate ($BaTiO_3$) thermal sensitive ceramic powder containing trivalent rare earth elements or pentavalent metal elements with an atomic ratio of the mixed trivalent rare earth elements to the barium (Ba) element of no greater than 1%, an atomic ratio of the pentavalent metal elements to the Titanium (Ti) element of no greater than 1%, and an atomic ratio of the Ba element and the trivalent rare earth elements to the Ti element and the pentavalent metal elements within a range between 0.99 and 1.01;

(2) mixing said formulation powder of the thermistor with that of the varistor according to a mass ratio of 1:2 to 2:1, ball-milling the mixture so that it is uniformly mixed, performing tape casting on the mixed powder thereby obtaining a green sheet with a thickness of 20 μm to 60 μm which operates as a green sheet of a transition layer;

(3) alternately laminating said green sheets of the varistor and nickel (Ni) electrodes, overlying said green sheet of the transition layer thereon, alternately laminating said green sheets of the thermistor and nickel (Ni) electrodes on said green sheet of the transition layer, performing hot isostatic pressing thereon, and cutting an obtained green sheet to a desired size according to electrode patterns thereof;

(4) processing said resistor in air at temperature below 500° C. after cutting;

(5) sintering said processed resistor in a protective atmosphere at temperature of 850° C. to 1150° C., performing heat treatment thereon in oxygen or air at temperature of 500° C. to 800° C., coating an Ag electrode thereon, and burning said Ag electrode.

2. The method of claim 1, wherein the thermal sensitive ceramic powder in said step (2) is obtained by a method for preparing nano powder.

3. The method of claim 2, wherein said method for preparing nano powder specifically refers to a hydrothermal method or a sol-gel method.

4. The method of claim 1, wherein in said step (1), an oxide of aluminum (Al) and/or an oxide of niobium (Nb) is/are added into said mixture of ZnO and $Bi_2O_3$, wherein the total amount being added is no greater than 4 mol %.

5. The method of claim 1, wherein in said step (1), one or more of an oxide of chromium (Cr), an oxide of antimony (Sb), an oxide of silicon (Si) and an oxide of vanadium (V) is/are added into said mixture of ZnO and $Bi_2O_3$, wherein the total amount being added is no greater than 8 mol %.

6. The method of claim 1, wherein the duration of ball-mill mixing in said step (1) is 3 to 5 hours.

7. The method of claim 1, wherein an average particle size of the thermal sensitive ceramic powder in said step (1) is no greater than 200 nm.

8. A laminated chip composite resistor combining a thermistor and a varistor prepared by the method of claim 1.

9. A laminated chip composite resistor combining a thermistor and a varistor, comprising a varistor part (1), a transition layer part (2) and a thermistor part (3) overlapped sequentially, wherein said varistor part (1) is formed by alternately laminating a ceramic layer of a varistor (11), a first electrode layer (12), another ceramic layer of a varistor (11') and a second electrode layer (13), wherein said first electrode layer (12) and said second electrode layer (13) are staggered, an end of said first electrode layer (12) is operated as a common end of inner electrodes of said composite resistor combining a thermistor and a varistor, and an end of said second electrode layer (13) is operated as a common end of inner electrodes of the varistor;

said thermistor part (3) is formed by alternately laminating a ceramic layer of a thermistor (31), a third electrode layer (32), another ceramic layer of a thermistor (31') and a fourth electrode layer (33), wherein said third electrode layer (32) and said fourth electrode layer (33) are staggered, an end of said third electrode layer (32) is operated as a common end of inner electrodes of said composite resistor combining a thermistor and a varistor, and an end of said fourth electrode layer (33) is operated as a common end of inner electrodes of the thermistor; and said transition layer part (2) is located between said thermistor part (3) and said varistor part (1).

10. The laminated chip composite resistor combining a thermistor and a varistor of claim 9, wherein an electrode material of said first electrode layer (12), said second electrode layer (13), said third electrode layer (32) and said fourth electrode layer (33) is nickel (Ni).

* * * * *